United States Patent [19]

Ferrari

[11] Patent Number: 4,927,138

[45] Date of Patent: May 22, 1990

[54] EXERCISE APPARATUS

[76] Inventor: Carlo V. G. Ferrari, 51 Hyde Crescent, Hendon, London N.W.9., England

[21] Appl. No.: 214,474

[22] Filed: Jul. 1, 1988

[30] Foreign Application Priority Data

Jan. 26, 1988 [GB] United Kingdom ..... 8801701

[51] Int. Cl.[5] ..... A63B 1/00; A63B 3/00

[52] U.S. Cl. ..... 272/70; 272/93; 272/DIG. 9

[58] Field of Search ..... 272/69, 116, 129, DIG. 5, 272/DIG. 6, DIG. 9, 100, 93, 120, 121, 125, 144, 70

[56] References Cited

U.S. PATENT DOCUMENTS

| | | | |
|---|---|---|---|
| 2,666,640 | 1/1954 | Jennings | 272/93 |
| 3,797,010 | 3/1974 | Adler et al. | 272/DIG. 9 |
| 4,192,000 | 3/1980 | Lipsey | 272/93 |
| 4,336,933 | 6/1982 | Appelbaum | 272/DIG. 9 |
| 4,477,070 | 10/1984 | Appelbaum | 272/DIG. 9 |
| 4,607,841 | 8/1986 | Gala | 272/125 |

FOREIGN PATENT DOCUMENTS

| | | | |
|---|---|---|---|
| 0140628 | 11/1979 | Japan | 272/DIG. 9 |

*Primary Examiner*—Stephen R. Crow
*Attorney, Agent, or Firm*—Notaro & Michalos

[57] ABSTRACT

Portable exercise apparatus comprises a base plinth pivotably connected to an upright member which carries an upper control and display panel. In the middle of the plinth is a forceplate on which a user can stand or run in place and which is associated with load sensing apparatus. Lateral hand grips are telescopically received in angle supports to enable the user to perform progressive resistance isotonic and isometric exercises, the expended exercise effort again being sensed by the forceplate by comparison to the user's static bodyweight and communicated to the user by visual or audible signals from the control panel. The equipment can be folded away into a flat box structure and carried by a handle.

4 Claims, 2 Drawing Sheets

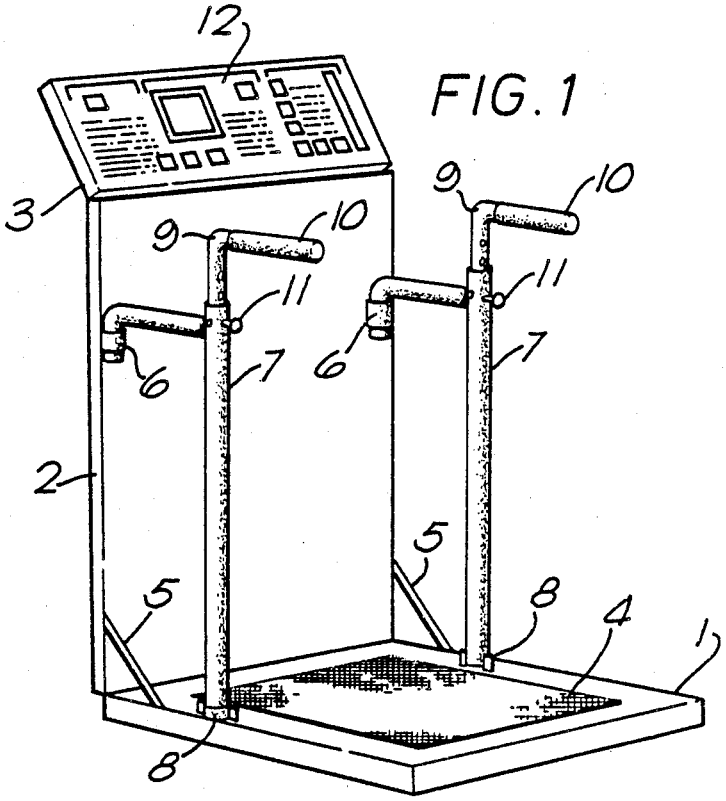
FIG. 1
FIG. 2A
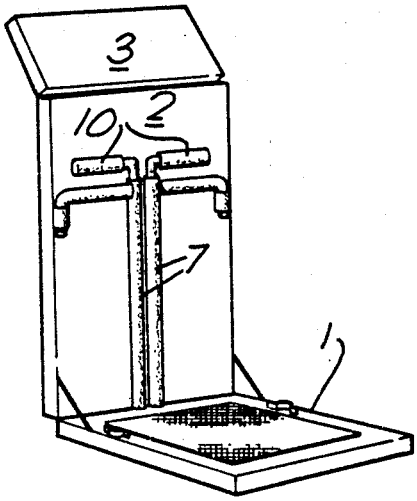
FIG. 2B
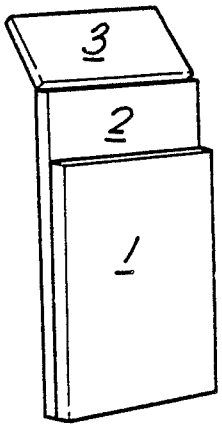
FIG. 2C
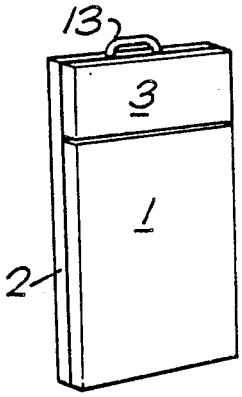

EXERCISE APPARATUS

FIELD AND BACKGROUND OF THE INVENTION

The latter part of the twentieth century has seen a substantial growth in the number of ordinary citizens participating in regular exercise. The reason for this is that lack of exercise has been discovered to be associated with ill health and premature death due, for example, to heart disease. Being overweight is an additional contributory factor. Whereas in the middle of the twentieth century being overweight was accepted as not abnormal in people of middle age, it is now unfashionable to be fat, to take unhealthy habits such as smoking and drinking to excess, and to be unfit or "out of shape".

Greater study of human fitness has shown that there are separate identifiable forms of exercise which have their own purpose and effect. One of the simplest forms of exercise is running which, without imposing too much strain on the body, enables the performer to expend his or her energy and raise their heart rate during the exercise period so as to improve their cardiovascular condition.

There are other forms of exercise based on running such as in many competitive sports. The level of expended effort in playing is affected by the game played and is therefore not wholly within the participant's control. Swimming is another form of cardiovascular exercise which, however, although easier than running in terms of strain on body joints is not as useful to the populace as a whole because it requires a swimming pool or the like which may not be conveniently available, and there can be breathing problems when the participant is short of breath and partially under water.

Another form of exercise which is not primarily intended to increase cardiovascular fitness to any great extent but does improve muscle tone and strength is resistance exercise where a participant flexes his or her muscles against the resistance of weights, springs or, in isometric exercise, statically against the resistance of other muscle groups in the body or an immovable object.

Ideally a combination of these forms of exercise, running and resistance exercise, gives the best overall result, but sometimes in practice such a combination is difficult to achieve. For example, in icy weather conditions, running is dangerous so an exerciser may be restricted to an indoor weight training apparatus. Equally an exerciser may be away from home and not readily able to find a weight training apparatus although they are able to run. Similarly time constraints may prevent a user from using an indoor exercise apparatus and in addition also going outdoors for a run.

SUMMARY OF THE INVENTION

It is an object of this invention to provide an apparatus which can be fixed but preferably is readily portable and which enables a user to carry out a running-type exercise or preferably both forms of exercise mentioned above and also includes controlling means adapted to monitor and communicate to the user the level of effort which they expend on the exercise.

According to the invention there is provided an exercise apparatus comprising a forceplate on which a user can stand and run in place. Static and impulse load sensing means are operatively associated with the forceplate, and electronic computing means are adapted to compare the output of the sensing means with the user's bodyweight in order to monitor and communicate to the user the expended exercise effort of running in place.

Preferably the apparatus also includes a pair of lateral hand grips about which the user can perform a progressive resistance isometric or isotonic exercise while standing on the forceplate, the computing means being adapted to compare the output of the sensing means with the user's own bodyweight in order to monitor and communicate to the user the expended exercise effort of said resistance exercise.

The computing means can be preprogrammed with exercise effort norms and communicates to the user when the norms are achieved. Alternatively or additionally the computing means may be adapted to be selectively programmed by the user with such norms. Thus, by comparing the static or impulse force sensed at the forceplate with the user's body weight and the norm selected, the computing means can communicate to the user their level of expended effort and particularly whether they have reached the norm they have set, or has been integrally pre-set.

For example, if the users are running in place, their feet will strike the forceplate with a force greater than their body weight because of the downward acceleration of their body mass. The greater the running speed or running effort, the greater the acceleration and the apparatus can be set to sense a particular norm associated with a particular running effort or speed. The apparatus can be set for example so that only when the norm is reached will it actually register that a step has been made. Thus if the user does not put in enough effort the apparatus will not sense any exercise or register the number of paces. Thus a ten minute run at a rate of seven minutes per mile could take considerably longer if the required effort is not put in. In another embodiment of the apparatus, an uphill gradient can be simulated by requiring a greater running-effort from the user.

The forceplate can be set into a plinth which can be pivotably connected to an upright member bearing the hand grips, the control panel being pivotably mounted atop the upright member.

BRIEF DESCRIPTION OF THE DRAWINGS

In order that the invention may be readily understood, an embodiment thereof will now be described by way of example with reference to the accompanying drawings in which:

FIG. 1 is a perspective view of the exercise apparatus in its operational state, FIGS. 2A, 2B and 2C show sequential views of the apparatus being packed away for transport.

DESCRIPTION OF THE PREFERRED EMBODIMENTS

Figure 3A:
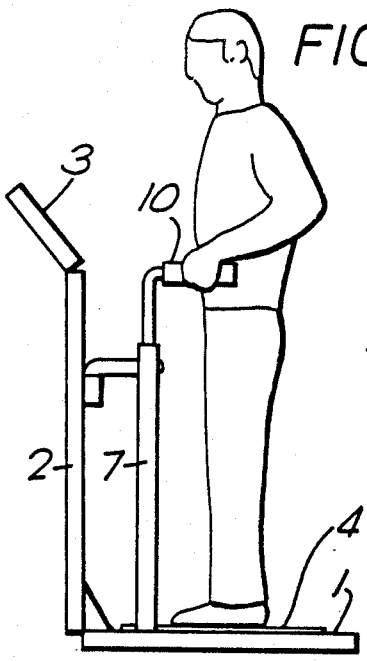
FIGS. 3A and 3B show the apparatus being used for one form of progressive resistance exercise.

The apparatus shown in FIG. 1 consists of three hingedly interconnected parts 1, 2 and 3. Part 1 is a floor mounted base which supports the remainder of the apparatus. In the center of the base is a forceplate 4 upon which a user stands and which is supported by springs, electronic sensors or the like which in conjunction with electrical means (not shown) are able to measure the static or impulse load on the forceplate.

The rear edge of part 2, which is supportedly connected to Part 1 by brackets 5 is an upstanding member which carries sockets 6 in which are pivotally located L-shaped portions of angled supports 7 which have lower ends that mount into further socket 8 mounted on base plate 1 near side edge there of. The supports 7 telescopically receive angle or L-shaped members 9 which form lateral hand grips 10 which can be raised or lowered and fixed in a desired position by means of pins 11 extending into corresponding apertures in member 9.

A display panel part 3 which is angularly inclined to part 2, so as to be easily seen by the user consists of various controls and visual display devices which are presettable and receive signals from forceplate 4 corresponding to the expended exercise effort sensed thereon. Part 3 has a display panel 12 consisting of an electronic screen, buttons, instructions and audible signal generating means adapted to communicate to the user the level of his expended exercise effort.

FIGS. 2A, 2B and 2C show that the apparatus can be packed away for portability. In FIG. 2A, the angular members 7 have been removed from brackets 8 and folded flat against part 2. In FIG. 2B, the base part 1 has been raised so as to lie substantially flat against part 2, and in FIG. 2C the hinged part 3 has been lowered so as to be contiguous with part 1 and reveal a carrying handle 13.

FIG. 3A shows the apparatus being used for an isometric exercise. The hand grip is set to a suitable height for the user's arms to be bent half way. The user can then press down on the handles without movement and the corresponding reduction in force sensed at the forceplate will be computed and communicated back to the user through the display panel as a measure of the actual force applied during the exercise.

Figure 3B:
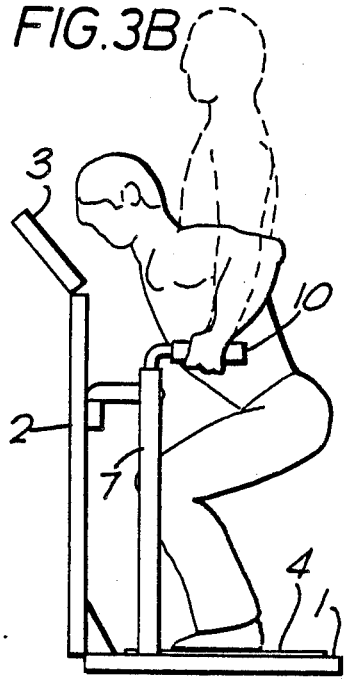

In FIG. 3B, the hand grips are set lower to enable isotonic performance of the same exercise. Here, the users bend their legs and can help restraighten their body by pressing downwards on the hand grips which will lower the load sensed on the forceplate by an amount equal to the exercising force generated by the arms.

Figure 4A:
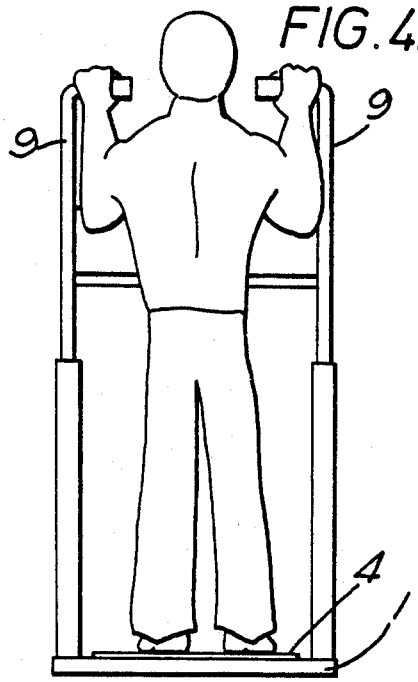
FIGS. 4A and 4B show the apparatus being used for another form of resistance exercise.
Figure 4B:
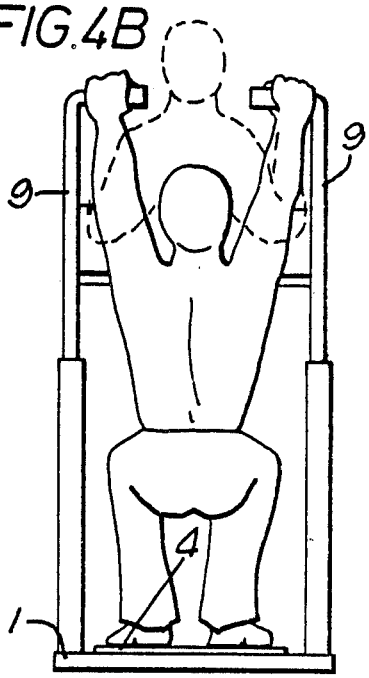

FIGS. 4A and 4B show similar exercises, i.e. isometric and isotonic exercises where the exercise is an overhead press, sometimes known as a standing press. In FIG. 4A the hand grips are set high and the user simply pushes up on them without movement which this time *increases* the force sensed on the forceplate. Again the display means will tell the user the actual exercising force and whether sufficient force has been expended, and can also compute the amount of time for which the exercise is performed. In FIG. 4B, an isotonic exercise is performed where the users bend their legs as they push up on the hand grips to obtain full extension of their arms.

Most of the more common exercises can be performed on the apparatus of the invention, for instance chinups, triceps pushdown, high pulls, biceps curls, and even a bench press where the bench is placed on the forceplate so that the sensing means can register the expended effort.

It will be seen that the apparatus of the invention is a highly versatile, compact and transportable means of performing a hitherto unachievable range of exercises in a single place.

I claim:

1. A portable exercise apparatus comprising:

a base member having a force plate thereon for receiving the force of a user standing and running in place on the force plate, the base member having a rear edge and opposite side edges;

an upstanding member hingedly connected to the rear edge of the base member, the upstanding member having a top edge and opposite side edges;

a display panel member hingedly connected to the top edge of the upstanding member;

a pair of first sockets connected to the upstanding member adjacent respective opposite side edges thereof;

a pair of second sockets connected to the base member adjacent respective opposite side edges thereof;

a first angled support having a lower end engageable into one of the second sockets, the first angled support having an upper end with a portion pivotally mounted in one of the first sockets;

a second angled support having a lower end engaged into the other of the second sockets, the second angled support having an upper end with a portion pivotally mounted in the other of the first sockets;

a pair of angle members, each angle member telescopically engaged into the upper end of one of the first and second angled supports, each angle member having a hand grip to be held by the user for conducting isometric, isotonic and running in place exercises on the force plate; and bracket means connected between the base member and the upstanding member for holding the upstanding member in an upstanding relationship to the base member, the lower ends of the angled supports being disengageable from the second sockets for pivoting the angled supports toward each other in the first sockets and against the upstanding member, and the base member and display panel member being pivotable against the upstanding member and over the folded angled supports for storage of the apparatus.

2. An apparatus according to claim 1 wherein the portions of the angled supports engaged in the first sockets are L-shaped and the angle members are each L-shaped.

3. An apparatus according to claim 2 including a plurality of holes in each angle member and a pin engageable into the upper end of each angled supports and into one hole of a respective angle member for adjusting the height of the hand grips with respect to the angled supports.

4. An apparatus according to claim 3 including a handle connected in the area of the connection between the upstanding member and the panel member for carrying the apparatus when it is folded.

* * * * *